United States Patent [19]

Heintzmann et al.

[11] Patent Number: 4,465,404

[45] Date of Patent: Aug. 14, 1984

[54] WALL ELEMENT FOR AN UNDERGROUND GALLERY

[75] Inventors: Peter Heintzmann, Bochum; Manfred Koppers, Duisburg; Karlheinz Bohnes, Bochum; Lothar Domanski, Oberhausen, all of Fed. Rep. of Germany

[73] Assignee: Bochumer Eisenhuette Heintzmann GmbH & Co KG, Bochum, Fed. Rep. of Germany

[21] Appl. No.: 396,687

[22] Filed: Jul. 9, 1982

[30] Foreign Application Priority Data

Jul. 14, 1981 [DE] Fed. Rep. of Germany ..... 3127812

[51] Int. Cl.[3] ..... E21D 11/00

[52] U.S. Cl. ..... 405/288; 405/150

[58] Field of Search ..... 405/150–153, 405/288, 132, 138, 141, 145, 146, 152

[56] References Cited

U.S. PATENT DOCUMENTS 2,062,686 12/1936 Toussaint ..... 405/288
3,168,815 2/1965 Blenkle et al. ..... 405/288

FOREIGN PATENT DOCUMENTS 186594 11/1955 Fed. Rep. of Germany ..... 405/288
802413 9/1936 France .
23736 9/1914 United Kingdom ..... 405/288

*Primary Examiner*—Dennis L. Taylor
*Attorney, Agent, or Firm*—Michael J. Striker

[57] ABSTRACT

A wall element for an underground gallery has a W-shaped member which is symmetrical relative to its y-axis and has an axis of gravity coinciding with its x-axis and lying at approximately the center of its side, wherein the thickness of its lateral flange portions, base portions and connecting web portions are selected so that, in relation to used weight per meter, the W-shaped member has a maximum possible moment of resistance relative to the x-axis and a maximum possible bending load capacity in the plastic deformation range, and the W-shaped member has such a profile and such thicknesses of these portions that it has at least approximately equal bending load capacities in the plastic deformation region in two opposite directions along the y-axis.

12 Claims, 6 Drawing Figures

WALL ELEMENT FOR AN UNDERGROUND GALLERY

BACKGROUND OF THE INVENTION

The present invention relates to a wall element for an underground gallery, particularly for a rigid or peripherally yieldable arcuate underground gallery. More particularly, the present invention relates to a wall element which is formed as a W-shaped member with bent away flanges, is symmetrical relative to a y-axis, formed so that its axis of gravity coincides with its x-axis and lies at least approximately in the center of the height, and has, in condition of considerably greater width than height such thicknesses of its base portions, flange portions and connecting web portions that, in relation to used weight per meter, it has a maximum possible moment of resistance relative to the x-axis and also a maximum possible bending load capacity in a plastic deformation region.

Wall elements of the above mentioned general type for arcuate, rigid or peripherally yieldable galleries are known in the art, for example from French Pat. Nos. 1,017,752, 802,413, or 967,283. They are also formed as pure roof bars or covers for galleries, as disclosed in the British Pat. No. 23,736 or the publication "Stahl e,uml/u/ berall", Vol. 4, 1935, page 38, Picture 63.

The wall elements of this type could not be used opposite to the double-webbed groove-shaped members, at least for the utilization in rigid or peripherally yieldable arcuate galleries. This is connected, first of all, with the fact that the conception of a W-shaped member serving as a wall of a gallery starts from an assumption of assembling two known double-webbed groove-shaped members. The W-shaped member produced in accordance with this conception has a doubled weight per meter and also a substantially doubled moment of resistance relative to the x-axis, as compared with the individual double-webbed groove-shaped members. Its utilization with rigid or peripherally yieldable arcuate galleries was considered as effective only in the event that there is a possibility to increase the distance of the arc in the longitudinal direction of the gallery, or practically to double the same. This assumption, however, fails when the groove-shaped member with high weight per meter is required, namely in galleries, particularly face roads which are continuously subjected to particularly high rock pressure applied from the mine face.

In practice, it is preferred to put the respective known two-webbed groove-shaped profiles in connection with an increasingly high weight per meter to a respectively high moment of resistance, particularly relative to the x-axis, and to introduce wall arcs assembled therefrom in short distances from one another. For these reasons, the known W-shaped members are practically replaced and, retroactively speaking, belong to paper art.

The present invention deals with a W-shaped member which was known for a long time for arcuate galleries with a completely new point of sight so that it is principally advantageous than the conventional two-webbed groove-shaped member which has increasing disadvantages in the fact that, when it is installed with its flanges or base portions toward rock, it provides for bending load capacities considerably deviating from one another. The difference in the bending load capacity can amount to 100% (Streckenausbau in Stahl, by Dr. Spruth Verlag, Glückauf GmbH, Essen, Issue 1955, page 106, paragraph 2 in connection with Picture 75 on page 110).

All attempts to eliminate or reduce these disadvantages of the double-webbed groove-shaped members on the way to pure optimization of the profile have failed. As a result of this, the disadvantages are accepted and a compromise is selected, to arrange the double-webbed groove-shaped members with their flanges toward the rock. In this case considerably smaller bending load capacity (working capacity) is used in the region of the roof, which is accompanied by the advantage of considerably higher bending load capacity in the region of both lateral thrust sides.

Considerations which take place here include that bending stresses which act from outside in the roof region of a wall curve as a resultant of the depth pressure act in predominant cases in a radius increasing manner, whereas in the region of both lateral legs at thrust sides they act in a radius reducing manner. The radius increasing load in the arc regions, i.e., first of all in the roof region, are considered to be sufficient when the flanges of the shaped member form a pressure zone, inasmuch as in the region of both thrust sides considerably high bending load capacity of the lateral legs can be exhausted relative to the opposite bending moment, when not the flanges but instead the base portions form the pressure zone.

Taking into consideration the considerably different bending load capacities depending upon whether the flanges or the base portions lie in the pressure zone, it is naturally desirable to arrange the double-webbed groove-shaped members in the roof region and in both thrust regions opposite to one another. This, however, is possible only in the event of multi-partite rigid curved walls, but not in a peripherally yieldable curved wall in which the grooved segments must be arranged in the same direction in one another to function properly.

Even without these disadvantages, such a solution encounters in practice considerable difficulties, inasmuch as it is impossible to predict at which location of the curved wall the region of the positive bending moment transit into the region of negative bending moment, since the location of the bending moment-reversing point depends on the outer loading conditions under the action of the rock pressure, and the bending stress is applied as a rule not centrally but eccentrically wherein the value of the eccentricity cannot be determined in advance.

SUMMARY OF THE INVENTION

Accordingly, it is an object of the present invention to provide a wall element for an underground gallery which avoids the disadvantages of the prior art.

More particularly, it is an object of the present invention to provide a wall element which is optimized in such a manner that, regardless of the direction of its arrangement, it is retained considerably identical in plastic deformation region.

In keeping with these objects, and with others which will become apparent hereinafter, one feature of the present invention resides, briefly stated, in a wall element which is formed as a V-shaped member having such a profile and thickness of its portions that it has at least approximately identical bending load capacities in the plastic deformation region in two opposite directions along a y-axis.

The invention is based on the fact that, in the quadruple-webbed W-shaped member, in contrast to the double-webbed groove-shaped member, it is possible to select the profile and the wall thickness distribution determined thereby such that its bending load capacity in the plastic deformation region in both mutually opposite bending directions deviate from one another only on the order of 10 to 15%. When the wall elements are designed in accordance with the invention, they can be arranged, practically regardless of the location of the bending moment-reversing point between the positive bending moment in the roof region and the negative bending moment in the thrust regions, in a favorable manner with its base portions toward the rock, without sacrificing in small bending load capacities, particularly in the region of both thrust sides of the gallery.

The inventive wall elements requires 25% more material than the known double-webbed groove-shaped members. However, it leads to a correspondingly increased bending load capacity. This disadvantage, in condition of identical distances between the flange portions of wall frames adjoining one another in the longitudinal direction of the gallery because of considerably greater width, are compensated so that the material consumption, relative to the gallery per meter, is substantially identical in both cases.

The arrangement of the flange portions away from the rock has a considerable advantage particularly in the event of utilization in peripherally yieldable curved galleries, in the fact that no connecting means for engaging the shaped members are necessary. Thereby no collisions during installation of the segments in the rock or covering the latter with resulting disturbance of operation can take place. Since no connecting means are provided at the side facing the rock, coating the V-shaped member with a suitable back filler is considerably improved.

Finally, the greater width of the shaped member in accordance with the invention has the considerable advantage that, relative to the gallery per meter, a smaller number of structural parts can be used, and the correspondingly smaller number of structural parts, including connecting means, must be handled.

The wall element designed in accordance with the present invention facilitates bringing the wall continuously with the aid of machines, and in the event of the peripherally yieldable gallery also facilitates actuation of its connecting means.

In accordance with another advantageous feature of the present invention, the ratio between the height and the width of the inventive shaped member is equal to approximately 1:3, whereas the total width of three base portions equals substantially 50% and the total width of the flange portions equals substantially 15% of the width of the shaped member.

It is to be understood that, when the wall elements are designed in accordance with the present invention, they can be used for different weight classes, and therefore the respective values are subjected to certain unavoidable width deviations depending upon the weight class.

It is especially advantageous when the base portions have an identical thickness, and the width of the central base portion is greater than the width of the outer base portion, whereas the base portions have an approximately identical thickness over their entire length and are slightly convex outwardly. The soft, harmonious transition from the concave base portion to the connecting web portions makes possible a relatively great working capacity, without transverse or longitudinal breakage.

A further advantageous feature of the present invention is that the thickness of the base portions is only insignificantly greater than the thickness of the connecting web portions in their thickest location, wherein the thickness of the base portions is equal to, or advantageously smaller than, one-tenth of the height of the shaped member.

Still a further advantageous feature of the present invention is that the flange portions are curved in a hook-shaped manner and have an increasing cross section toward their free ends so as to form beads at the free ends. The flange portions can have an average thickness approximately equal to the thickness of the base portions. The flange portions, which are thicker towards their ends, facilitate bringing the connecting means without the danger that they can be removed during pulling in the insertion direction from the flange portions.

In accordance with a further, especially advantageous feature of the present invention, the connecting web portions have identical lengths and include two outer connecting web portions and two inner connecting web portions, of which the inner web portions each have a reversing point at the height of the axis of gravity and a thickness increasing from the reversing point in both directions toward the respective base portions. The outer connecting web portions have in the center a greater thickness than the inner connecting web portions and are somewhat inwardly curved, and have a thickness continuously increasing from a respective flange portion toward a respective base portion.

The bending load capacity in the known W-shaped element in both opposite bending directions deviate from one another by substantially 30%. The wall element in accordance with the present invention has a difference of approximately 10%, i.e. a deviation between both bending load capacities or the respective working capacities which is not disadvantageous in practice.

The novel features which are considered characteristic for the present invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
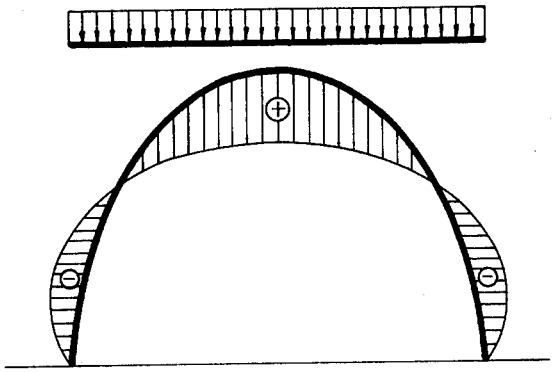
FIG. 1 is a view showing an imaginary limiting case of loading of a gallery wall under the action of purely vertical gallery load.
Figure 2:
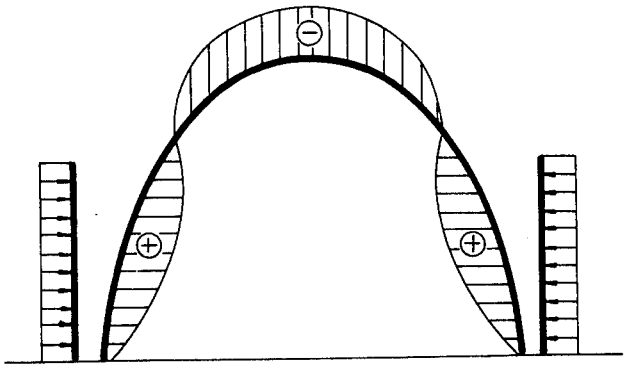
FIG. 2 is a view showing another imaginary limiting case of loading of a gallery wall under the action of purely thrust pressure from horizontal gallery loads.

FIGS. 1 and 2 show two imaginary limiting cases illustrating distribution of positive and negative moment areas over a gallery curve. FIG. 1 illustrates a case in which only vertical gallery loads act upon a curved wall, whereas FIG. 2 illustrates a case in which horizontal gallery loads generated by thrust pressure act. In the purely imaginary conditions of the case shown in FIG. 1, radius-increasing bending deformations take place in the roof region and radius-decreasing bending deformations take place in both thrust regions. Thereby the bending moments act in the roof region are positive and the bending moment which takes place in both thrust regions is negative. With the opposite load illustrated in FIG. 2, the conditions are different, in the sense that the radius-decreasing (negative) bending moment acts in the roof region and the radius-increasing (positive) bending moment acts in both thrust regions. In both the above illustrated cases, a bending moment-reversing point occurs in a transition region between the roof arc and the lateral legs. The sign of the bending moment changes in these reversing points.

In practice, the above illustrated, imaginary limiting cases do not exist. In addition to the fact that both stresses as resultants of the depth pressure overlap one another more or less, additional eccentric moments generated, for example, from the mine face occur in practice and make impossible prediction of the actual loading conditions, and the final judgement whether it is advisable to arrange the double-webbed groove-shaped member either with its flanges or with its base portions toward the rock. This is despite the fact that for years it was known that the double-webbed groove-shaped members have bending load capacities which differ from one another by 100% in dependence upon whether the base portions or the flange portions form the pressure zone of the bending deformation.

Althought it is theoretically possible in the event of multi-partite rigid gallery arcs to arrange the wall segments partially with their flanges and partially with their base portions toward the rock to utilize their respective higher bending load capacity, this practically fails inasmuch as it cannot be predicted in which peripheral region positive or negative bending moments take place under the action of loading and at which locations the bending moment reverse occurs.

This dilemna is eliminated when the wall element is designed in accordance with the present invention, since it has in both opposite bending directions bending load capacities which are approximately identical for practical use, and thereby it is not important for their bending condition when their flange portions face toward the rock or toward the gallery. This does not contradict the fact that, in practical use, it is advisable to arrange the wall element with its flanges toward the gallery, particularly of known peripherally yieldable gallery walls.

Figure 3:
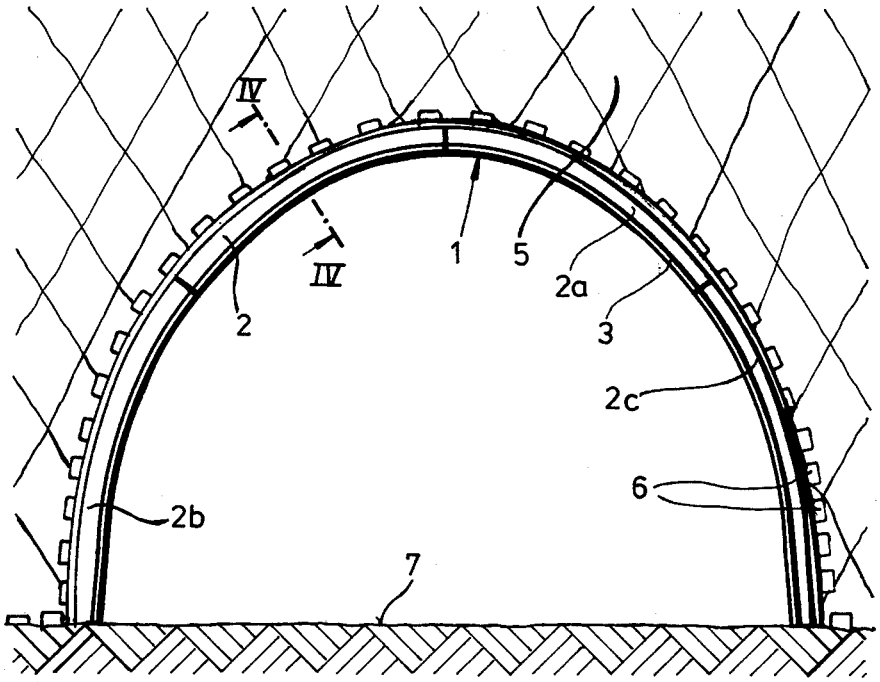
FIG. 3 is a view schematically showing a cross section of a gallery with a rigid wall assembled from four segments.
Figure 4:
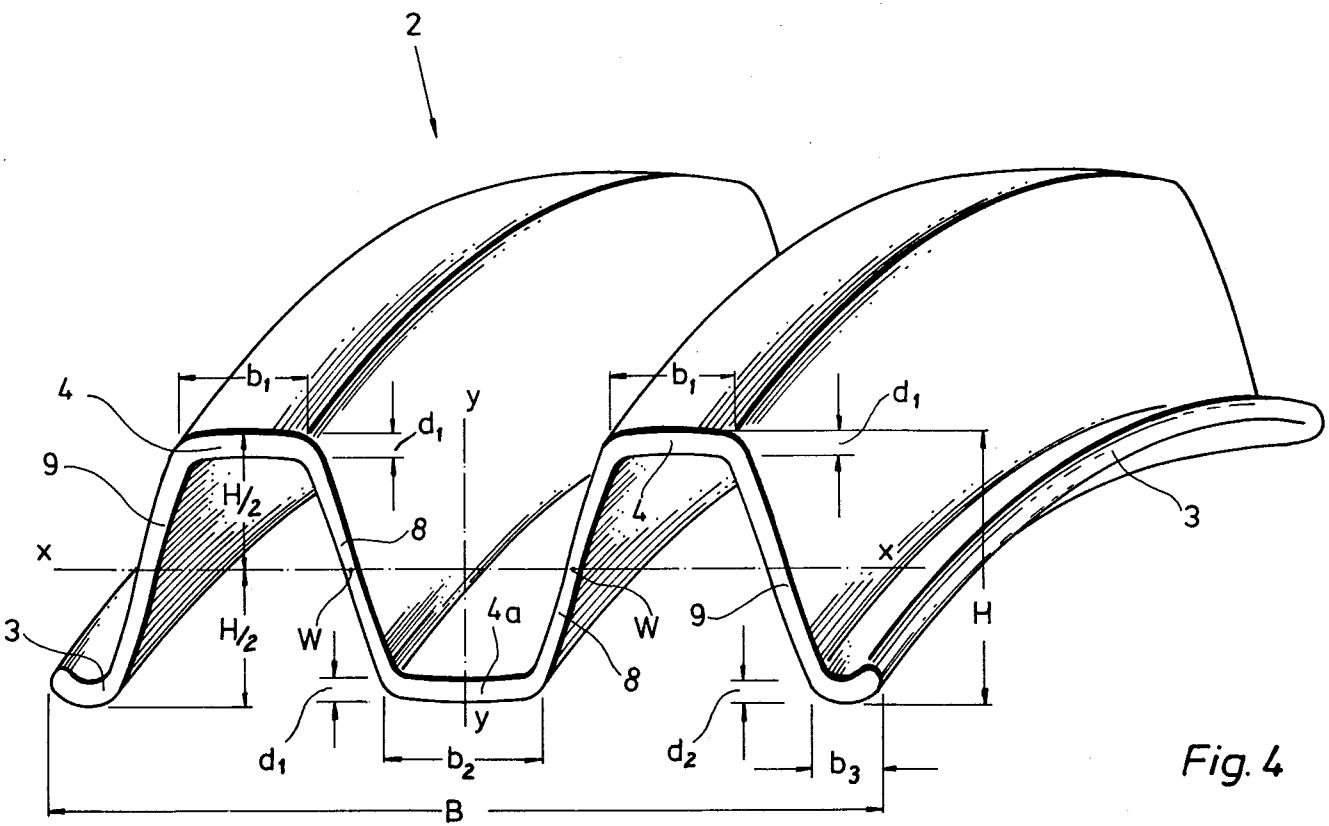
FIG. 4 is a view showing a W-shaped wall element in accordance with the present invention, taken along the line 4—4 in FIG. 3 in perspective view.

FIGS. 3 and 4 show an individual wall element for assembling a multi-partite rigid wall frame 1. The wall element is identified by reference numeral 2. The wall frame 1 has four such wall elements, namely two roof elements 2 and 2*a* and two thrust elements 2*b* and 2*c*. The elements are connected at their opposite ends in a known manner firmly, but releasably, with one another, for example by means of shackles which are not shown in the drawing.

All four segments, which together form the wall frame 1, are arranged as can be seen in FIG. 3 so that their flange portions 3 face toward the interior of the gallery and their two base portions 4 face toward a rock 5, for example with interposition of suitable back filler, which is identified in FIG. 3 by reference numeral 6. Reference numeral 7 identifies a gallery floor in FIG. 3.

The wall element 2 is W-shaped, as can be seen in FIG. 4, and can be substituted by wall elements 2*a*, 2*b* and 2*c* with regard to their shapes which correspond to one another. As can be seen from the drawing, the wall element is symmetrical relative to the y-axis and formed such that its axis of gravity, which coincides with its x-axis, extends in an advantageous case shown in the drawing in the center of the height H of the element.

The width B and the height H of the element are so determined upon one another that their ratio is approximately 3:1, i.e., the width B of the element corresponds to approximately three times the height H of the same. Both outer base portions 4 and an inner base portion 4*a* located therebetween have together a total width which is equal to substantially 50% of the width B of the wall element, or approximately one-half the same. The end flange portions 3 are bent away laterally and together have a total width which is equal to approximately 15% of the width B of the wall element.

As can be seen from FIG. 4, both outer base portions 4 and the central base portion 4*a* have identical thicknesses $d_1$. Their thickness corresponds to substantially one-twelfth the height H of the wall element. The wall thickness $d_1$ is identical over the considerable region of the width of the base portions. The base portions are somewhat curved outwardly. As can be further seen from FIG. 4, both outer base portions 4 have identical widths $b_1$, whereas the central base portion 4*a* has a greater width $b_2$.

The flange portions 3 are curved in a hook-like manner and have a thickness increasing toward their free end in a beadlike manner. Their average thickness $d_2$ is at least approximately equal to the thickness $d_1$ of the base portions 4 or 4*a*. As can finally be seen from FIG. 4, the thickness of the base portions 4 and 4*a* is only insignificantly greater than the thickness of connecting webs at their thickest points. Connecting webs have identical lengths. Two central connecting webs 8 are formed such that they have a reversing point W at the height of the axis of gravity x—x. Their thickness increases from the reversing point W in both opposite directions towards the thicker base portions 4 and 4*a*, and finally transit into the latter.

In contrast, two outer connecting webs 9 do not have a reversing point and are somewhat curved inwardly. Their average thickness is greater than the thickness of the central connecting webs 8 and increases from the flange portions 3 toward the base portions 4. While the smallest thickness of the outer connecting webs 9 is located in the region of transition of the connecting webs to the flange portions 3, the smallest thickness of both central webs 8 is located in the region of the reversing point W.

The flange portions 3 which, as mentioned above, are hook-shaped and thickening towards their ends, each have a width $b_3$, and their total width is at least approximately equal to 15% of the width B of the wall element.

Figure 5:
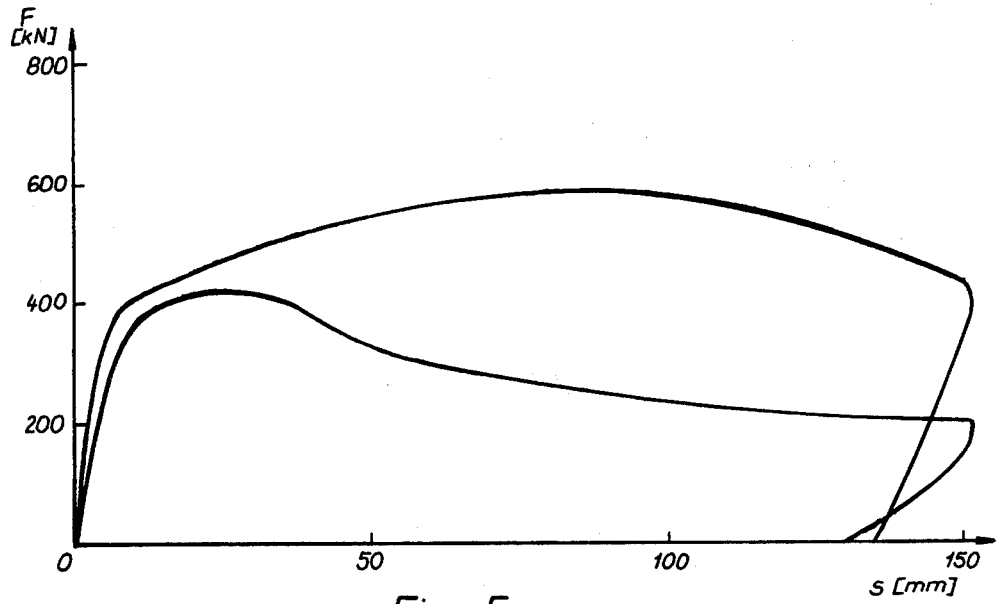
FIG. 5 is a view showing working curves of a conventional double-webbed grooved shaped member in the weight class 37 kg/m, in the event of opposite bending loads, wherein the base portions and the flange portions of the wall element are in the pressure zone of the bending deformation.
Figure 6:
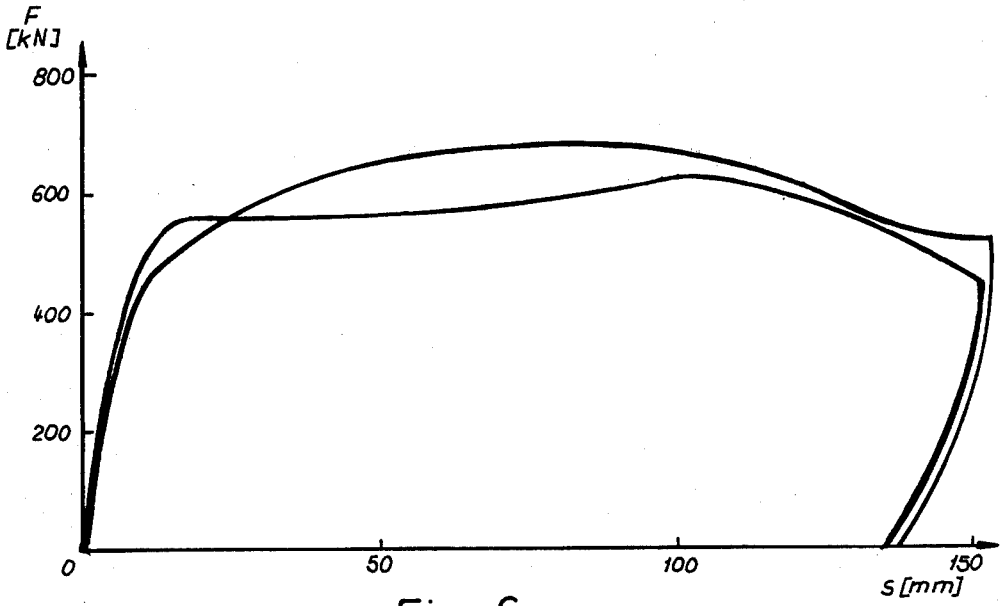
FIG. 6 is a view substantially corresponding to the view of FIG. 5, but showing the working curves for the inventive wall element of the weight class 44 kg/m.

FIGS. 5 and 6 show two working curves under bending load, wherein FIG. 5 shows a market-available double-webbed groove-shaped element of the weight class 36 kg/m, and FIG. 6 shows the W-shaped wall element in accordance with the present invention of the weight class 44 kg/m.

In both cases the abscissa shows the absolute value of bending s in millimeters, whereas the ordinate shows the height of loading F in kN.

In both cases, the higher curve corresponds to a bending stress of a wall element in which the base portion or base portions lie in the pressure zone, whereas the lower curve corresponds to the bending load capacity of the wall element under bending stresses in which the flange portions lie in the pressure zone.

As can be seen from evaluation of FIG. 5, corresponding to the market-available double-webbed grooved shaped element of the weight class 36 kg/m, the curves of both opposite loading cases, in which the base portions form the pressure zone, on the one hand, or the flange portions form the pressure zone, on the other hand, considerably differ from one another.

The areas under both curves, defining the working capacities, are obtained for the case where the base portions form the pressure zone (the upper curve) of a value of 74 kNm, and for the case when the flange portions lie in the pressure zone (the lower curve) of a value of 43 kNm. When a higher value with 100% is applied, the working capacity for the unfavorable case where the flange portions lie in the pressure zone is only 58%. In contrast, the working capacity of the inventive wall element of the weight class 44 kg/m shown in FIG. 6 is equal for the case where both outer base portions 4 lie in the pressure zone (the upper curve) to 88 kNm, and is equal for the case where the flange portions lie in the pressure zone to 85 kNm. The unfavorable value lies within only 4% below the 100% applied higher value.

In addition to the advantage of at least approximately identical bending load capacities in both opposite bending directions, the bending load capacity, with consideration of the higher weight per meter, is higher by a respective value than the bending load capacity of the market-available double-webbed grooved shaped member of the weight class 36 kg/m, as can be seen from FIG. 5.

It will be understood that each of the elements described above, or two or more together, may also find a useful application in other types of constructions differing from the types described above.

While the invention has been illustrated and described as embodied in a wall element for an underground gallery, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A wall element for an underground gallery, comprising a W-shaped member having a height extending along a Y-axis and a width extending along an X-axis, said W-shaped member being formed so that it is symmetrical relative to the Y-axis and its axis of gravity coincides with the X-axis and lies at least approximately in a center of its height, said W-shaped member having bent away lateral flange portions, base portions and connecting web portions, said inner and outer connecting web portions having different thicknesses, the width of said W-shaped member being considerably greater than the height thereof, and the thicknesses of said portions being selected so that, in relation to used weight per meter, said W-shaped member has a maximum possible moment of resistance relative to the X-axis and a maximum possible bending load capacity in a plastic deformation region, said W-shaped member having such a profile and such thicknesses of said portions that said W-shaped member has at least approximately equal bending load capacity in the plastic deformation region in two opposite directions along the Y-axis.

2. A wall element as defined in claim 1, wherein the ratio between the height and the width of said W-shaped member is at least approximately equal to 1:3, said W-shaped member having three said base portions with a total width which substantially corresponds to 50% of the width of the W-shaped member, said W-shaped member having two said flange portions with a total width substantially corresponding to 15% of the width of the W-shaped member.

3. A wall element as defined in claim 1, wherein said W-shaped member has three said base portions including one central base portion and two outer base portions, said base portions having substantially identical thicknesses, said central base portion having a width which exceeds the width of each of said outer base portions.

4. A wall element as defined in claim 1, wherein each of said base portions has a approximately equal thickness over a great part of its width and is somewhat convex outwardly in direction of the Y-axis.

5. A wall element as defined in claim 1, wherein said connecting web portions have a varying thickness along their lengths, said base portions having a thickness which is only insignificantly greater than the thickness of said connecting web portions at their thickest locations.

6. A wall element as defined in claim 5, wherein said base portions have a thickness which is at least approximately equal to one tenth of the height of said W-shaped member.

7. A wall element as defined in claim 1, wherein each of said flange portions has a free end, each of said flange portions being curved in a hook-like manner and having a thickness increasing toward the free end so as to form a bead at the latter.

8. A wall element as defined in claim 7, wherein said base portions have a predetermined thickness, each of said flange portions having an average thickness which is at least approximately equal to the thickness of said base portions.

9. A wall element as defined in claim 1, wherein said W-shaped member has four said connecting web portions including two inner connecting web portions and two outer connecting web portions, each of said inner connecting web portions having a reversing point at the height of said X-axis and a thickness increasing from said reversing point in opposite directions toward said base portions.

10. A wall element as defined in claim 9, wherein each of said outer connecting web portions has a center with a thickness exceeding the thickness of said inner connecting web portions and is inwardly curved, each of said outer connecting web portions having a thickness increasing from a respective one of said flange portions toward a respective one of said base portions.

11. A wall element as defined in claim 9, wherein said connecting web portions have identical lengths.

12. A wall element for an underground gallery, comprising a W-shaped member having a height extending along a Y-axis and a width extending along an X-axis, said W-shaped member being formed so that it is symmetrical relative to the Y-axis and its axis of gravity coincides with the X-axis and lies at least approximately in a center of its height, said W-shaped member having bent away lateral flange portions, one central and two outer base portions, and two inner and two outer connecting web portions with different thicknesses, the width of said W-shaped member being considerably greater than the height thereof, and the thicknesses of said portions being selected so that, in relation to used weight per meter, said W-shaped member has a maximum possible moment of resistance relative to the X-axis and a maximum possible bending load capacity in a plastic deformation region, said W-shaped member having such a profile and such thicknesses of said portions that said W-shaped member has at least approximately equal bending load capacity in the plastic deformation region in two opposite directions along the Y-axis, each of said flange portions being curved in a hook-like manner, said central base portion having a width which exceeds the width of each of said outer base portion, each of said base portions having an approximately identical thickness over a greater part of its width and being somewhat convex outwardly in direction of the Y-axis, each of said inner connecting web portions having a reversing point at the height of said X-axis and a thickness increasing from said reversing point in opposite directions toward said base portions, and each of said outer connecting web portions having a center with a thickness exceeding the thickness of said inner connecting web portions and being inwardly curved, and also having a thickness increasing from a respective one of said flange portions toward a respective one of said base portions.

* * * * *